US010988360B2

(12) United States Patent
Cherry et al.

(10) Patent No.: US 10,988,360 B2
(45) Date of Patent: Apr. 27, 2021

(54) FORK RUNNERS

(71) Applicant: Hyster-Yale Group, Inc., Fairview, OR (US)

(72) Inventors: Tim Cherry, Greenville, NC (US); Kevin Butler, Greenville, NC (US)

(73) Assignee: HYSTER-YALE GROUP, INC., Fairview, OR (US)

( * ) Notice: Subject to any disclaimer, the term of this patent is extended or adjusted under 35 U.S.C. 154(b) by 436 days.

(21) Appl. No.: 15/976,147

(22) Filed: May 10, 2018

(65) Prior Publication Data

US 2018/0327239 A1 Nov. 15, 2018

Related U.S. Application Data

(60) Provisional application No. 62/504,302, filed on May 10, 2017.

(51) Int. Cl.
*B66F 9/12* (2006.01)

(52) U.S. Cl.
CPC ..... *B66F 9/12* (2013.01)

(58) Field of Classification Search
CPC ..... B66F 9/07504
USPC ..... 280/43.12
See application file for complete search history.

(56) References Cited

U.S. PATENT DOCUMENTS 3,381,937 A * 5/1968 Zillman ..... B66F 9/12 254/104
3,561,628 A * 2/1971 Melin ..... B66F 9/122 414/664
3,758,075 A * 9/1973 Briggs ..... B62B 3/06 254/2 R
4,102,464 A * 7/1978 Schuster ..... B66F 9/12 293/107
5,221,176 A * 6/1993 Allen ..... B66F 9/12 414/607
5,497,569 A * 3/1996 Byman ..... B66F 9/12 15/245
5,575,608 A * 11/1996 Yau ..... B66F 9/12 414/607
5,897,286 A * 4/1999 Whittaker ..... B66F 9/12 187/237
6,042,329 A * 3/2000 Marquez ..... B62B 3/0612 414/607
6,471,465 B2 * 10/2002 Albertyn ..... B66F 9/12 414/607

(Continued)

FOREIGN PATENT DOCUMENTS

CN 203451174 U 2/2014

OTHER PUBLICATIONS

Fastenal, Fork Tine Covers, website: https://www.fastenal.com/products?term=fork+tine+covers; 2016; pp. 1-2.

*Primary Examiner* — Jeffrey J Restifo
(74) *Attorney, Agent, or Firm* — Schwabe Williamson & Wyatt

(57) ABSTRACT

Fork runners removably secured to a fork optionally permit fork runners to be of a different material from the fork and to be readily replaced. The fork includes an upper surface and a downward depending portion extending therefrom, and the fork runner includes an elongated fastening plate that is releasably secured to the downward depending portion.

20 Claims, 2 Drawing Sheets

(56) References Cited

U.S. PATENT DOCUMENTS

| | | | | |
|---|---|---|---|---|
| 6,632,064 | B1 * | 10/2003 | Walker | B65F 1/122 220/908 |
| 8,632,082 | B2 * | 1/2014 | Lantz | B66F 9/0755 280/43.12 |
| 9,394,150 | B2 * | 7/2016 | Bow | B66F 9/18 |
| D796,149 | S * | 8/2017 | Takaguchi | D34/35 |
| 10,214,401 | B2 * | 2/2019 | Brunckhorst | B62B 5/0079 |
| 10,589,929 | B2 * | 3/2020 | Iellimo | B65G 1/0492 |
| 2004/0161327 | A1 | 8/2004 | Paxton | |
| 2007/0116547 | A1 | 5/2007 | Bulkeley | |
| 2007/0170002 | A1 | 7/2007 | Ziebell | |
| 2008/0310946 | A1 | 12/2008 | Allen | |

* cited by examiner

FORK RUNNERS

CROSS REFERENCE TO RELATED APPLICATIONS

The present application claims priority to U.S. Provisional Patent Application No. 62/504,302, filed May 10, 2017, entitled "FORK RUNNERS," the disclosure of which is hereby incorporated by reference in its entirety for all purposes, except those sections, if any, that are inconsistent with this specification.

TECHNICAL FIELD

Embodiments relate to forks for pallet trucks, particularly fork runners included on pallet truck forks.

BACKGROUND

Fork runners included on the bottom of pallet truck forks change the lower edge profile of such forks to facilitate entry and removal from pallet pockets. Commonly available fork runners are non-releasably secured to the bottom surface of pallet truck forks, such as by welding. Removal of fork runners requires that they be cut free of the fork, which can cause damage to the fork.

DETAILED DESCRIPTION OF DISCLOSED EMBODIMENTS

Figure 1:
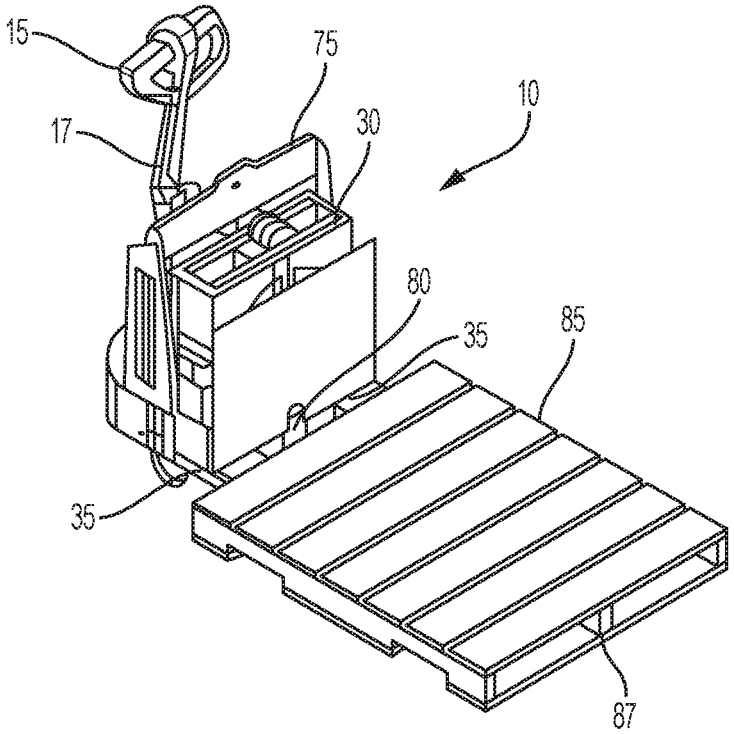
FIG. 1 illustrates a rear right isometric view of one example of a pallet truck with its forks inserted into a pallet.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Embodiments provide fork runners that may be removably secured to a fork, for instance, for use with a pallet truck or pallet jack. Fork runners are elements that extend from the bottom surface of each fork, and they engage the bottom boards of a pallet during loading and unloading maneuvers. Unlike conventional fork runners, which generally are welded to a bottom surface of each fork, removably securing the fork runners to the forks permits the fork runners to be replaced easily in the event that they become worn or damaged from use. Removably securing the fork runners to the forks also permits the fork runners to be formed from a different material from the fork.

The present inventors have recognized that typical techniques for attaching a runner to a pallet truck fork are time consuming, and they require the fork material to be protected during the processes of attaching the fork runners to the fork, as well as when the forks are painted and shipped. Fork runners are commonly non-releasably or permanently secured to a fork in a manner that requires cutting or otherwise damaging the fork in the event that a fork runner needs to be removed. Typically, fork runners are coupled to a fork by welding, which requires the fork runner to be made from a material that can be welded, such as steel.

The present inventors have also recognized that when fork runners are removably secured to a fork, the fork runners optionally may be made from a much wider range of materials, including materials that are dissimilar from the material used to make the fork. For example, pallet truck forks commonly are formed from steel. When a fork runner is removably secured to a fork instead of welded to the fork, the fork runner may still be made from steel, but it optionally can be made of a material with a lower coefficient of friction compared to steel. Using a material with a low coefficient of friction can be advantageous, particularly when engaging an unloaded pallet. Whereas steel and other materials having a higher coefficient of friction may tend to cause a pallet to slide away from the forks during a loading operation, materials having a low coefficient of friction may slide over the bottom deck boards of the pallet with greater ease.

The coefficient of friction is a dimensionless scalar value that describes the ratio of the force of friction between two bodies and the force pressing them together. The coefficient of friction depends on the materials used; for example, ice on steel has a low coefficient of friction, while rubber on pavement has a high coefficient of friction. Coefficients of friction range from near zero to greater than one. Surfaces at rest tend to have a higher coefficient of friction (i.e., coefficient of static friction) compared to surfaces in relative motion (i.e., coefficient of kinetic friction). For example, steel-on-wood has a coefficient of kinetic friction of about 0.25 and a coefficient of static friction of about 0.45. Thus, fork runners made from a material having a coefficient of kinetic friction of less than about 0.25 or a coefficient of static friction of less than about 0.45 typically will allow the forks to more effectively engage a pallet compared to steel fork runners. Specific, non-limiting examples of suitable materials having low coefficients of friction (both static and kinetic) when engaging wood pallets include ultra-high molecular weight plastics, high-density polyethylene, or ultra high-density polyethylene. As used herein, the term "high-density polyethylene" refers to a polyethylene material having a molecular weight of about 300,000 to 500,000. By contrast, the term "ultra high-density polyethylene" refers to a polyethylene material having a molecular weight of about 3,000,000 to 6,000,000. One of skill in the art will appreciate that although these specific examples of suitable materials are provided, any material with suitable characteristics, such as a coefficient of static friction of less than about 0.45, 0.35, 0.25, 0.20, or even lower, may be substituted, so long as such material also has sufficient hardness, density, workability, etc. for the particular application.

The present inventors have also recognized that removably securing a runner to a fork permits such a runner to be readily replaced in the event that it becomes worn or damaged. In some examples, a material with a low coefficient of friction may provide greater hardness, density, or durability compared to steel, and as such, the fork runners may resist damage, even with heavy use. However, in some examples, the selected material may exhibit less hardness, density, or durability compared to steel. In those examples, the fork runners may be removed from the fork and replaced as needed, for example if heavy use causes wear or damage.

An embodiment is described with reference to FIGS. 1 and 2A-2D. FIG. 1 illustrates a rear right isometric view of one example of a pallet truck with its forks inserted into a pallet. A pallet truck 10 includes a control handle 15 that is attached to a steering arm 17. Rotation of control handle 15 actuates steering arm 17 to cause rotation of a drive wheel (not illustrated), and thus control the direction of travel of pallet truck 10. Pallet truck 10 is moved by a traction motor (not illustrated) that is energized by a battery 30. A pair of forks 35 is raised and lowered via a hydraulic cylinder (not illustrated).

To lift a load, an operator maneuvers forks 35 into or underneath a load, such as pallet 85. When maneuvering underneath pallet 85, forks 35 typically engage the bottom boards 87. When pallet 85 is unladen, or has a very light load on it, forks 35 may engage bottom boards 87 and cause pallet 85 to move away from forks 35, instead of remaining stationary while forks 35 enter pallet 85 for subsequent lifting.

Figure 2A:
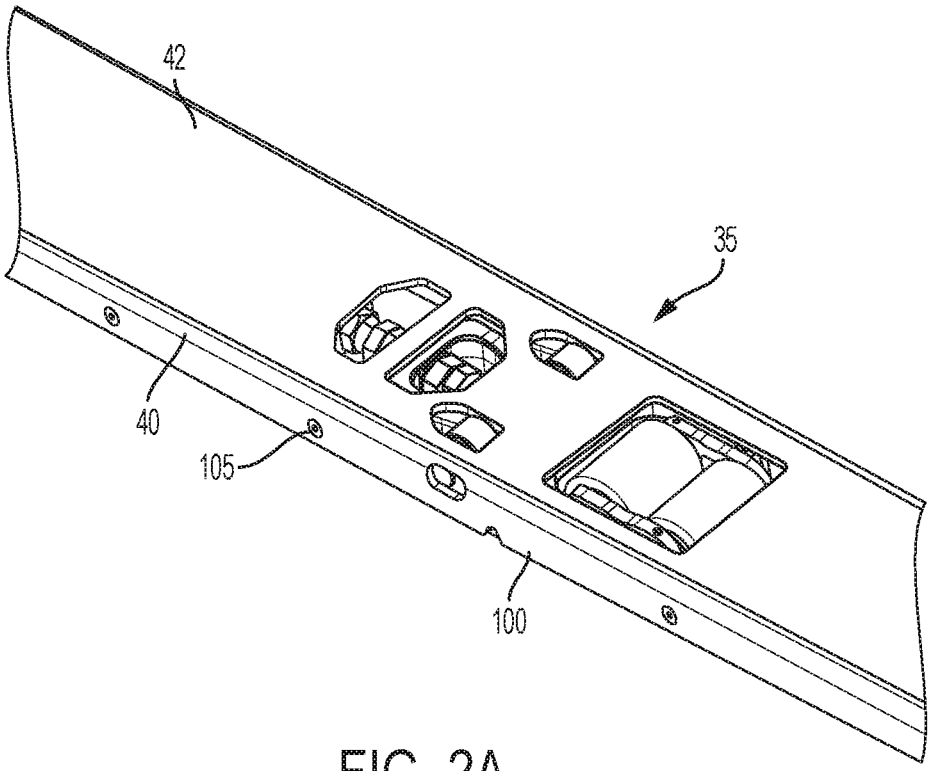
FIG. 2A illustrates a close-up rear right isometric view of the fork of the pallet truck of FIG. 1, shown with one example of a bolted-on fork runner installed.

FIG. 2A illustrates a close-up rear right isometric view of the fork of the pallet truck of FIG. 1, shown with one example of a bolted-on fork runner installed. Although only one fork is illustrated, it will be appreciated that the second fork is substantially the same. Although only one fork runner is illustrated, one of skill in the art will appreciate that a second fork runner may be installed on the opposite side of the fork, and that the second fork runner may be the mirror image of the illustrated fork runner. To facilitate entry of forks 35 into pallet 85 over bottom boards 87, a fork runner 100 may be secured to a downward depending portion 40 of fork 35. Downward depending portion 40 extends from a top surface 42 of fork 35 and extends towards a floor or ground that supports the pallet truck 10. In the illustrated embodiment, fork runner 100 is recessed into downward-depending portion 40 of fork 35 such that it lies flush with the outer contour of fork 35. In other embodiments, however, such as when fork runner 100 is added as an after-market component, fork runner 100 may not be recessed into downward depending portion of fork 35. In these embodiments, the portion of fork runner 100 that couples to downward depending portion 40 of fork 35 may be tapered or otherwise contoured to prevent fork runner from snagging on the pallet blocks. Although fork runner 100 is illustrated as extending along only a short portion of the length of fork 35, in other embodiments, fork runner 100 may extend along a longer portion of fork 35, or along most of all of fork 35. In still other embodiments, fork runner may be shorter than illustrated, and/or may extend along only a forward portion of fork 35, such as immediately behind the fork tip.

Figure 2B:
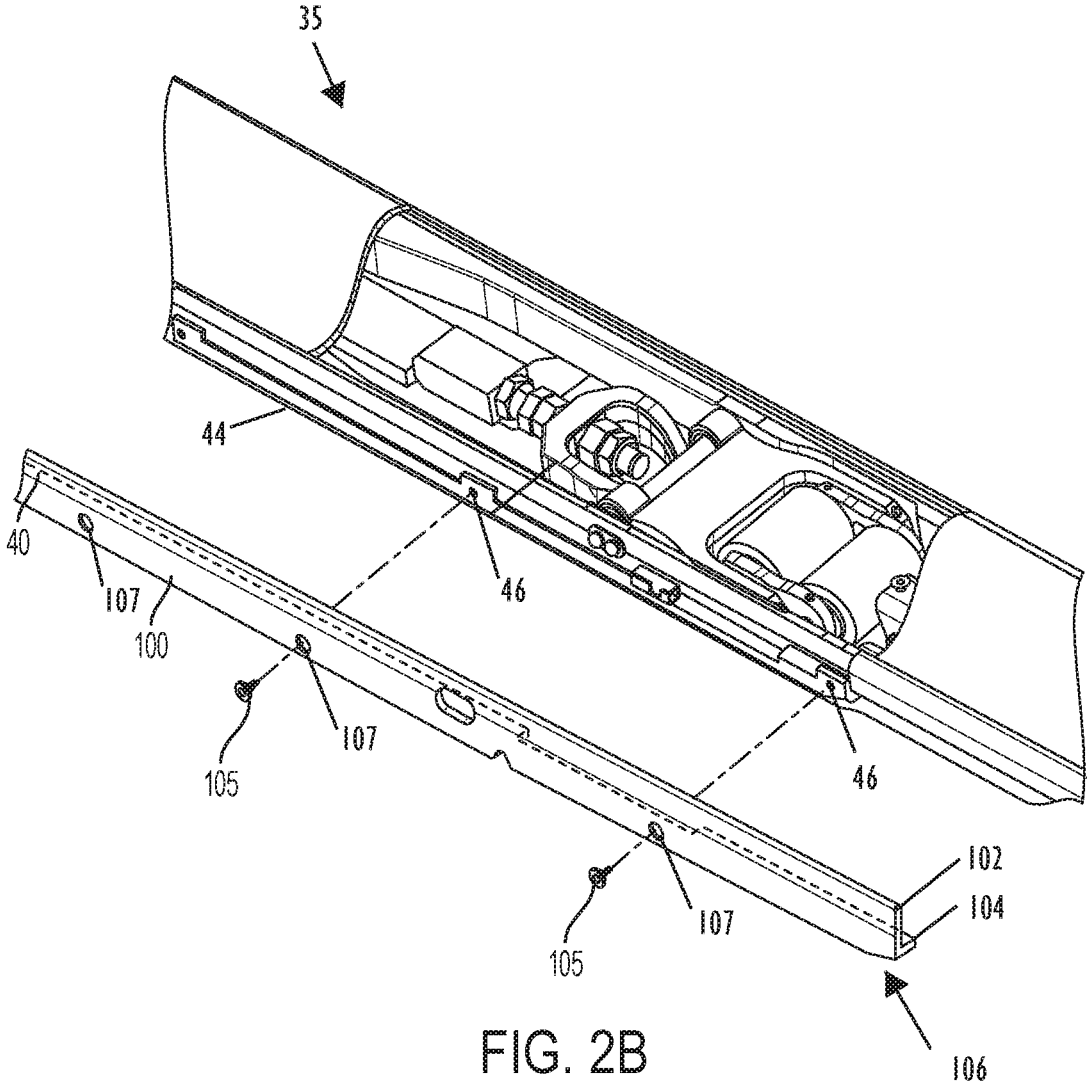
FIG. 2B illustrates a close-up rear right isometric partial cutaway view of the fork of FIG. 2A, shown with the fork runner removed.
Figure 2C:
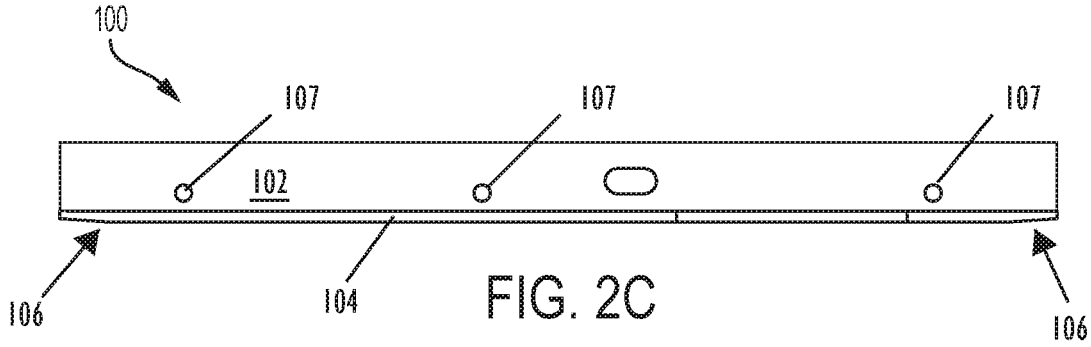
FIG. 2C illustrates a side view of the fork runner of FIG. 2A.
Figure 2D:
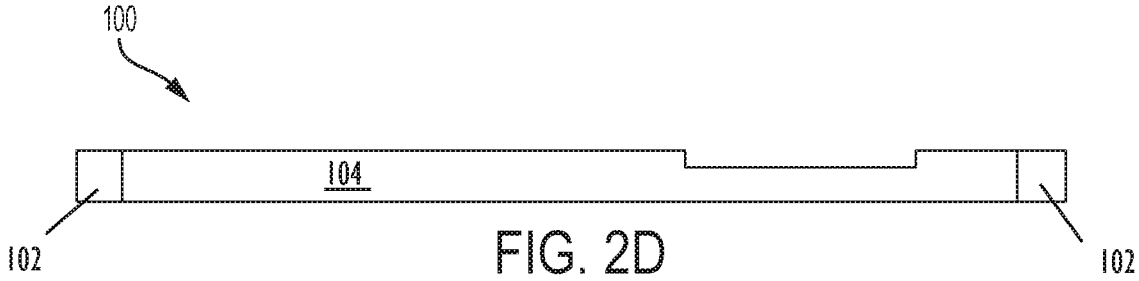
FIG. 2D illustrates a bottom view of the fork runner of FIG. 2A.

FIG. 2B illustrates a close-up rear right isometric partial cutaway view of the fork of FIG. 2A, shown with the fork runner removed; FIG. 2C illustrates a side view of the fork runner of FIG. 2A; and FIG. 2D illustrates a bottom view of the fork runner of FIG. 2A. Although the specific dimensions of fork runner 100 may be adapted to suit the contours of a particular fork, or the needs of a particular application, fork runner 100 includes an elongated fastening plate 102 that is sized and shaped to align and mate with downward-depending portion 40 of fork 35. Fork runner 100 also includes an elongated lower portion 104 that extends from fastening plate 102 in an approximately perpendicular direction such that lower portion 104 aligns and mates with a bottom surface 44 of fork 35.

Fork runner 100 changes the lower profile of the fork 35 bottom surface 44 and, as shown in FIGS. 2B-2D, typically includes one or more ramped surfaces 106 to facilitate moving the forks 35 underneath an unladen pallet 85 and over bottom boards 87. Although short, shallow ramped surfaces 106 are illustrated, it will be appreciated that in other embodiments the ramped surfaces may be steeper or more shallow, and may extend over a shorter portion or longer portion of elongated lower portion 104. Similarly, although straight ramps are illustrated, with a gradual but uniform increase in thickness of elongated lower portion 104, one of skill in the art will appreciate that the steepness of ramped surfaces may vary to form curved ramped surfaces.

Fork runners 100 are optionally secured to downward depending fork portions 40 in a manner that permits fork runners 100 to be releasably secured to forks 35 such that fork runners 100 may be removed from forks 35 without damaging forks 35, and without cutting fork runners 100 free from forks 35. In the illustrated embodiment, fork runners 100 are releasably secured to forks 35 via bolts 105 which pass through apertures 107 in elongated fastening plate 102. In some embodiments, threaded apertures 46 may be included in downward depending portion 40 to threadingly receive bolts 105, whereas in other embodiments, non-threaded apertures 46 may be included in downward depending portion 40 to accommodate bolts 105 that are secured via nuts. In another embodiment, fork runners 100 may be releasably secured to forks 35 via rivets which may be drilled out when a fork runner 100 is to be replaced. In yet another embodiment, a groove may be cut into a top surface of fork runner 100 such that the fork runner 100 may be snapped into place by an interference fit between the groove and a portion of the downward depending portion 40 of forks 35. In still other embodiments, other fastening systems may be used, such as brackets, spring-loaded hooks or other tensioned members, and the like. In yet other embodiments, fork runner 100 may be secured to any suitable portion of forks 35. In the illustrated embodiment, removing bolts 105 facilitates replacing fork runners 100, for example when a runner 100 becomes worn.

Optionally, fork runners 100 are made of a material with a lower coefficient of friction than the steel used to make forks 35, and are preferably made from a material that is not capable of being welded to forks 35. In some embodiments, fork runners may be made from a material having a coefficient of static friction (e.g., when engaging with wood) of less than about 0.45, such as about 0.4, 0.35, 0.30, 0.25, 0.20, or even less. In some embodiments, fork runners 100 may be made from ultra-high molecular weight plastics, high-density polyethylene, or ultra high-density polyethylene.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A pallet truck fork comprising:

a fork configured to engage a pallet; and a fork runner releasably secured to the fork, wherein the fork comprises a top surface and a downward depending portion extending therefrom, and wherein the fork runner comprises an elongated fastening plate sized and shaped to align and mate with the downward depending portion of the fork, wherein the downward depending portion of the fork comprises a recessed portion sized and shaped to receive the elongated fastening plate, and wherein the elongated fastening plate does not extend beyond an outer contour of the fork when secured to the fork.

2. The pallet truck fork of claim 1, wherein the fork runner further comprises an elongated lower portion extending from the elongated fastening plate in a substantially perpendicular plane.

3. The pallet truck fork of claim 2, wherein the elongated lower portion is sized and shaped to align and mate with a bottom surface of the fork.

4. The pallet truck fork of claim 1, wherein the fork runner is releasably secured to the fork with a releasable fastener.

5. The pallet truck fork of claim 4, wherein the releasable fastener comprises a bolt or a rivet.

6. The pallet truck fork of claim 1, wherein the elongated fastening plate is secured to the downward depending portion of the fork with a releasable fastener.

7. The pallet truck fork of claim 6, wherein the releasable fastener comprises a bolt or a rivet.

8. The pallet truck fork of claim 1, wherein the fork runner is made from a material that is not capable of being welded to the fork.

9. The pallet truck fork of claim 1, wherein the fork runner is made from a material having a kinetic coefficient of friction when engaging with wood that is less than about 0.45.

10. The pallet truck fork of claim 1, wherein the fork runner is made from an ultra-high molecular weight plastic, a high-density polyethylene, or an ultra high-density polyethylene.

11. A pallet truck fork comprising:

a fork configured to engage a pallet; and a fork runner releasably secured to the fork, wherein the fork comprises a top surface and a downward depending portion extending therefrom, and wherein the fork runner comprises an elongated fastening plate sized and shaped to align and mate with the downward depending portion of the fork, wherein the fork runner further comprises an elongated lower portion extending from the elongated fastening plate in a substantially perpendicular plane, wherein the elongated lower portion is sized and shaped to align and mate with a bottom surface of the fork, and wherein the elongated lower portion extends beyond an outer contour of the fork when the fork runner is releasably secured to the fork.

12. The pallet truck fork of claim 11, wherein the elongated lower portion has a non-uniform thickness dimension.

13. The pallet truck fork of claim 11, wherein the elongated lower portion comprises at least one ramp.

14. The pallet truck fork of claim 11, wherein the fork runner is releasably secured to the fork with a releasable fastener.

15. The pallet truck fork of claim 14, wherein the releasable fastener comprises a bolt or a rivet.

16. The pallet truck fork of claim 11, wherein the elongated fastening plate is secured to the downward depending portion of the fork with a releasable fastener.

17. The pallet truck fork of claim 10, wherein the releasable fastener comprises a bolt or a rivet.

18. The pallet truck fork of claim 11, wherein the fork runner is made from a material that is not capable of being welded to the fork.

19. The pallet truck fork of claim 11, wherein the fork runner is made from a material having a kinetic coefficient of friction when engaging with wood that is less than about 0.45.

20. The pallet truck fork of claim 11, wherein the fork runner is made from an ultra-high molecular weight plastic, a high-density polyethylene, or an ultra high-density polyethylene.

* * * * *